US007323949B2

(12) United States Patent
Forslund

(10) Patent No.: US 7,323,949 B2
(45) Date of Patent: Jan. 29, 2008

(54) METHOD FOR CONVERSION OF WAVEGUIDE MODES, MODE-CONVERTING ARRANGEMENT AND ANTENNA ARRANGEMENT

(75) Inventor: Ola Forslund, Sundbyberg (SE)

(73) Assignee: Saab AB, Linköping (SE)

( * ) Notice: Subject to any disclaimer, the term of this patent is extended or adjusted under 35 U.S.C. 154(b) by 182 days.

(21) Appl. No.: 10/535,236

(22) PCT Filed: Nov. 14, 2003

(86) PCT No.: PCT/SE03/01768

§ 371 (c)(1),
(2), (4) Date: Oct. 4, 2005

(87) PCT Pub. No.: WO2004/047217

PCT Pub. Date: Jun. 3, 2004

(65) Prior Publication Data

US 2006/0152297 A1 Jul. 13, 2006

(30) Foreign Application Priority Data

Nov. 18, 2002 (SE) ..... 0203390

(51) Int. Cl.
*H01P 1/16* (2006.01)
*H01P 1/163* (2006.01)

(52) U.S. Cl. ..... 333/21 R; 333/251

(58) Field of Classification Search ..... 333/21 R, 333/21 A, 81 B, 137, 157, 251
See application file for complete search history.

(56) References Cited

U.S. PATENT DOCUMENTS 2,656,513 A * 10/1953 King ..... 333/21 R (Continued)

FOREIGN PATENT DOCUMENTS

EP 0330539 A1 8/1989

(Continued)

OTHER PUBLICATIONS

Robert L. Eisenhart; A Novel Wideband TMO1-to-TE11 Mode Converter; 1998 IEEE MTT-S Digest; pp. 249-252; AN: 5985784; vol. 1.

(Continued)

*Primary Examiner*—Dean Takaoka
(74) *Attorney, Agent, or Firm*—Venable LLP; Eric J. Franklin

(57) ABSTRACT

The invention relates to a method for conversion of waveguide modes from a mode of type $TM_{01}$ to mode of type $TE_{11}$ for transmission of power within the microwave range. The invention also relates to a mode-converting arrangement and an antenna arrangement with such a mode converting arrangement. The mode-converting arrangement comprises an incoming waveguide (1) for reception of power of the type $TM_{01}$-an outgoing waveguide (6) for outputting power of mode type $TE_{11}$ and a waveguide-mode-converting section (2-5) arranged between the incoming and outgoing waveguides. According to the invention, incoming power of mode type $TM_{01}$ is divided in an input section (2) between two or more waveguides with cross-sections in the shape of circle sectors. Thereafter, the divided power is phase-shifted by the waveguides in a subsequent phase-shift section (4) being designed with cross-sections that are essentially in the shape of circle sectors with different radii, after which the waveguides are changed into a common essentially circular waveguide (6) that emits an outgoing power of mode type $TE_{11}$. By means of the invention, a relatively simple solution is produced that can cope with high powers.

17 Claims, 5 Drawing Sheets

U.S. PATENT DOCUMENTS

| | | | | | |
|---|---|---|---|---|---|
| 2,760,171 | A | * | 8/1956 | King | 333/251 |
| 2,864,063 | A | * | 12/1958 | Felsen et al. | 333/157 |
| 3,259,903 | A | * | 7/1966 | Lerner | 343/778 |
| 3,271,773 | A | * | 9/1966 | Wheeler | 343/778 |
| 4,890,117 | A | * | 12/1989 | de Ronde | 343/773 |
| 4,973,924 | A | | 11/1990 | Bergero et al. | |
| 4,999,591 | A | | 3/1991 | Koslover et al. | |
| 5,004,990 | A | * | 4/1991 | Bergero et al. | 333/22 R |

FOREIGN PATENT DOCUMENTS

GB 468548 A 7/1937

OTHER PUBLICATIONS

Shiwen Yang and Hongfu Li; Optimization of Novel High-Power Millimeter-Wave $TM_{01}$-$TE_{11}$ Mode Converters; IEEE Transactions on Microwave Theory and Techniques; Apr. 1997; pp. 552-554, AN: 5561877 vol. 45, No. 4.

G. Janzen; Mode Converters from $TE_{0m}$ to $TE_{m0}$ for High-Power Applications in the Frequency Range 1 to 30 GHz; Int. J. Electronics; 1984; pp. 1219-1224, AN: 2531643; vol. 57, No. 6.

Constantine A. Balanis; Circular Cross-Section Waveguides and Cavities; Advanced Engineering Electromagnetics; pp. 470-495; Chapter 9; John Wiley & Sons.

* cited by examiner $TE_{11}$ $TE_{11}$ $TM_{01}$ $TE_{21}$ $TE_{21}$

METHOD FOR CONVERSION OF WAVEGUIDE MODES, MODE-CONVERTING ARRANGEMENT AND ANTENNA ARRANGEMENT

CROSS-REFERENCE TO RELATED APPLICATIONS

This application claims priority to Swedish patent application 0203390-0 filed 18 Nov. 2002 and is the national phase under 35 U.S.C. § 371 of PCT/SE2003/001768.

FIELD OF THE INVENTION

The present invention relates to a method for conversion of waveguide modes from a mode of type $TM_{01}$ to mode of type $TE_{11}$ for transmission of power within the microwave range. The invention also relates to a mode-converting arrangement for conversion of waveguide modes from a mode of type $TM_{01}$ to mode of type $TE_{11}$ for transmission of power within the microwave range, comprising an incoming waveguide for reception of power of the type $TM_{01}$, an outgoing waveguide for outputting power of the mode type $TE_{11}$ and a waveguide-mode-converting section arranged between the incoming and outgoing waveguides. In addition, the invention relates to an antenna arrangement with mode converter according to the invention.

BACKGROUND OF THE INVENTION

In certain situations, where power is to be transferred from, for example, a microwave generator to an antenna, it is of interest to change from one waveguide mode to one or more other modes. With power generation in certain microwave generators, the power is delivered typically in a so-called $TM_{01}$ mode in a circular waveguide. For a more detailed description of the mode type, refer to "Balanis, Advanced Engineering Electromagnetics, Wiley 1989". This mode is often not suitable for exciting an antenna, for example of the waveguide horn type, due to the fact that it gives a toroidal radiation pattern with a zero depth in the axial direction of the waveguide. In many situations, it is therefore of interest to deliver the power in a circular waveguide in $TE_{11}$ mode. If linear polarization is of interest, the power is delivered accordingly in one $TE_{11}$ mode. For the generation of circular polarization in an antenna, the power can be delivered in two orthogonal $TE_{11}$ modes excited 90 degrees out of phase in time.

Conversion of $TM_{01}$ mode to $TE_{11}$ mode is known in connection with the exciting of antennas, see for example U.S. Pat. No. 4,999,591. The mode converter described in this document has limitations regarding polarization and can be difficult to manufacture with precision due to its asymmetrical design.

Mode converters for converting power from the circular so-called $TM_{01}$ mode to one or two $TE_{11}$ modes are difficult to achieve, particularly if they are to cope with high power.

SUMMARY OF THE INVENTION

The object of the present invention is to achieve a method for conversion of waveguide modes, a mode-converting arrangement, and an antenna arrangement which can cope with high powers and can handle different types of polarization in different variants and which mode-converting arrangement has an essentially symmetrical shape and is relatively simple in its construction.

The object is achieved by means of a method characterized in that incoming power of mode type $TM_{01}$ is divided between two or more waveguides with cross-sections that are essentially in the shape of circle sectors, in that the divided power is phase-shifted by the waveguides in a subsequent phase-shift section by means of waveguides with cross-sections essentially in the shape of circle sectors with different radii, after which the waveguides are changed into a common essentially circular waveguide that emits an outgoing power of mode type $TE_{11}$, and a mode-converting arrangement characterized in that the waveguide-mode-converting section comprises at least one input section for dividing the received power into two or more components and a phase-shift section at the output side of the input section with an allocated waveguide for each power component, with the waveguides being designed with cross-sections that are essentially in the shape of circle sectors with different radii emanating from a common center and such that the cross-sections in the shape of circle sectors together essentially cover 360 degrees. The change is carried out in a plurality of sections where, in particular, the design of the phase-shift section with different radii is of decisive significance for the function. The mode-converting arrangement according to the invention and defined above is relatively narrow-band and can cope with high powers. By placing the mode-converting arrangement in a vacuum in association with the microwave generator, the arrangement can cope with even higher powers.

According to an advantageous method, the conversion of waveguide mode from mode type $TM_{01}$ to mode type $TE_{11}$ is caused, in an intermediate stage comprising four separate waveguides, to assume four modes each of which has a field configuration that constitutes a quarter of a so-called $TE_{21}$ mode in a corresponding circular waveguide. By means of this method, the power in a circular $TM_{01}$ mode can be converted to two $TE_{11}$ modes 90 degrees out of phase, for the generation of circular polarization in an antenna.

The mode-converting arrangement is advantageously provided with a mode-mixer section included in connection with the outgoing waveguide, which mode-mixer section comprises a change from a plurality of waveguides with cross-sections in the shape of circle sectors to one waveguide with an essentially circular cross-section. In the mode-mixer section, two basic modes of $TE_{11}$ type are propagated first of all. The change in the mode-mixer section can be designed as an abrupt change. Alternatively, the change is designed to be gradual, by the change having an extent in the transmission direction that corresponds to at least $\lambda_0/4$, where $\lambda_0$ denotes the free-space wavelength for the center frequency in the band that is transmitted by the arrangement. In a proposed embodiment, the output of the mode-mixer section forms the outgoing waveguide of the arrangement. This output can, for example, be connected to a conical-shaped waveguide horn.

According to an advantageous embodiment of the mode-converting arrangement, a balance section is included, connected to the output side of the phase-shift section and comprising waveguides with cross-sections that are essentially in the shape of circle sectors with the same radii in order to balance the field configurations of the waves that leave the different waveguides of the phase-shift section.

According to yet another advantageous embodiment of the mode-converting arrangement, there is an intermediate section between the input section and the phase-shift section, which intermediate section comprises a plurality of waveguides with cross-sections in the shape of circle sectors and essentially identical radii.

In two suitable embodiments, the input section of the mode-converting arrangement is designed to divide the received power into two or four components respectively. By means of the division into two components, conversion can be carried out to one $TE_{11}$ mode, while division into four components is suited for conversion of the power to two $TE_{11}$ modes which are 90 degrees out of phase with each other.

According to yet another advantageous embodiment of the invention, the input section comprises thin ridges for dividing the received power, which ridges increase in size in the transmission direction from the periphery of the input section inwards towards the middle of the input section so that they meet at the output side of the input section. The ridges can be designed to increase in size continuously or in steps in the transmission direction.

BRIEF DESCRIPTION OF THE DRAWINGS

The invention will be described below with reference to the attached drawings, in which.

DETAILED DECSRIPTION OF EMBODIMENTS OF THE INVENTION

Figure 3A:
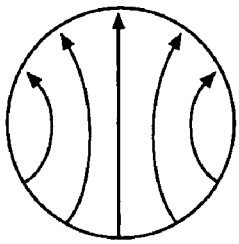
FIG. 3 shows schematically the transverse E-fields for the waveguide modes $TE_{11}$, $TM_{01}$ and $TE_{21}$.
Figure 3B:
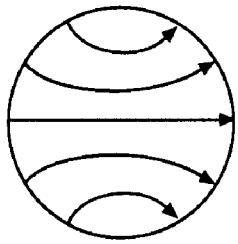
Figure 3C:
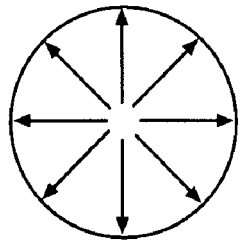
Figure 3D:
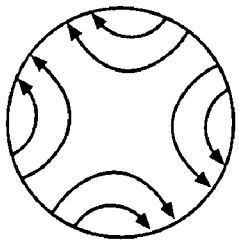
Figure 3E:
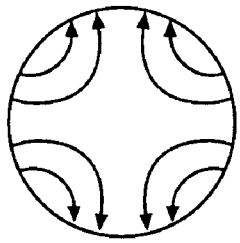

The appearance of the transverse E-fields for the three modes that are principally of relevance for the invention is described schematically, prior to the description below of the mode-converting arrangement. FIGS. 3*a* and 3*b* show the transverse E-fields for two orthogonal $TE_{11}$ modes. FIG. 3*c* shows the transverse field for the $TM_{01}$ mode. FIG. 3*d* and FIG. 3*e* show the transverse E-fields for two $TE_{21}$ modes.

Figure 1:
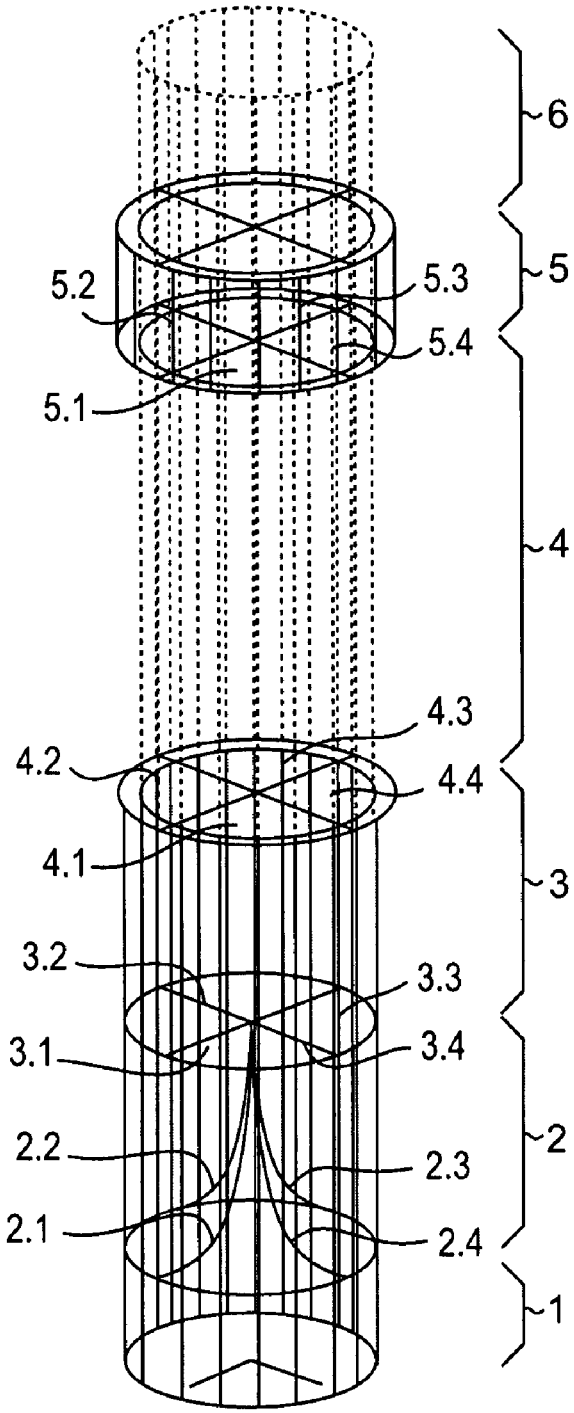
FIG. 1 shows an example of a mode-converting arrangement according to the invention with change to two $TE_{11}$ modes excited 90 degrees out of phase.

The example shown in FIG. 1 of a mode-converting arrangement with change to two $TE_{11}$ modes comprises an incoming waveguide 1, an input section 2, an intermediate section 3, a phase-shift section 4, a balance section 5 and a mode-mixer section 6. The output of the mode-mixer section is designed to be connected directly or via a separate outgoing waveguide to the exciter unit, typically a waveguide horn, in an antenna. The construction and tasks of the sections involved are described below, step by step, starting with the input side of the mode-converting arrangement.

The incoming waveguide 1 consists here of a circular hollow guide that is assumed to be able to propagate at least five modes, namely two $TE_{11}$ modes, so-called basic modes, the $TM_{01}$ mode and two $TE_{21}$ modes. The only excited mode is, however, the $TM_{01}$ mode.

Figure 4A:
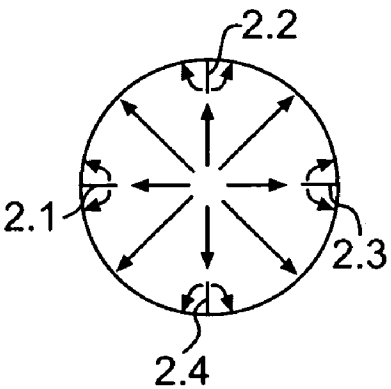
FIG. 4 shows schematically the transverse E-fields in different parts of the mode-converting arrangement according to FIG. 1.
Figure 4B:
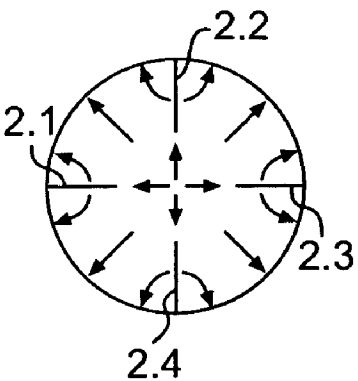
Figure 4C:
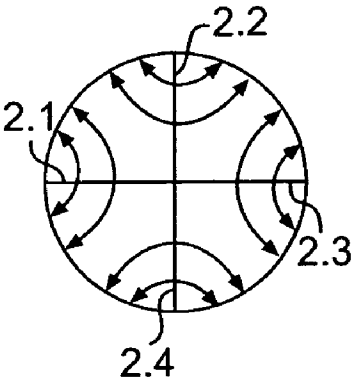

The incoming waveguide 1 is followed by the input section 2. The input section has a circular cylindrical shape and comprises four thin rounded ridges 2.1-2.4. The ridges are separated at 90 degrees from each other along the circular cylindrical surface of the input section and run parallel to the axis of rotation for the circular cylindrical surface. The ridges are shaped to gradually increase in size towards the axis of rotation along the direction of transmission of the mode-converting arrangement so that they meet at the output side of the input section. FIGS. 4*a*-4*c* show schematically the field configuration for the transverse E-fields as the ridges gradually increase in size in the input section 2. FIG. 4*a* shows the field configuration close to the input side of the input section, FIG. 4*b* shows the field configuration further into the input section and FIG. 4*c* shows the field configuration on the output side of the input section where the ridges meet. No high field strengths arise in the input section when the distance between the ridges is made smaller on account of the fact that the transverse electrical field, the E-field, on both sides of the middle of the waveguide has the opposite direction for the $TM_{01}$ mode. This is essential in order for the waveguide change to be able to withstand high power. The input section is suitably given a length longer than or equal to $\lambda_0/4$ and for example $\lambda_0$, where $\lambda_0$ denotes the free-space wavelength of the center frequency in the band. The input section must have a certain length in order that the mode-converting arrangement will not be mismatched and give a high reflection coefficient. Where the ridges 2.1-2.4 meet at the output side of the input section 2, the original circular waveguide has changed to four waveguides with cross-sections that are in the shape of 90 degree circle sectors.

Figure 7A:
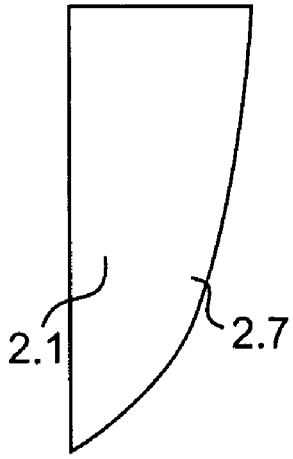
FIGS. 7*a* and 7*b* show in side view two different examples of ridge elements that can be included in the mode-converting arrangement according to the invention.
Figure 7B:
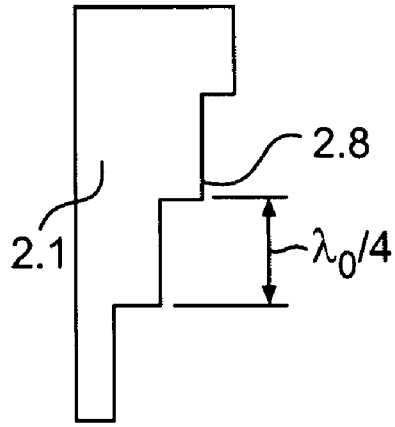

FIG. 7*a* shows in side view a ridge 2.1 comprised in the input section 2, according to the embodiment described with reference to FIG. 1. The ridge has an edge 2.7 that increases in size continuously. Alternatively, it is however possible to introduce an edge 2.8 with a stepped increase as shown in FIG. 7*b*. A suitable step length is $\lambda_0/4$.

The four waveguides 3.1-3.4 form the intermediate section 3. In these waveguides only one mode is now propagated in each waveguide 3.1-3.4. These modes each constitute "one quarter" of a so-called $TE_{21}$ mode for the original waveguide and have the same propagation constant as the $TE_{21}$ modes that can propagate in the original circular waveguide. The extension of the thin ridges 2.1-2.4 into the intermediate section defines a symmetry plane in relation to which the E-field for the $TE_{21}$ mode is orthogonal in the incoming circular waveguide 1. The introduction of the ridge extensions as walls has not changed anything as far as the $TE_{21}$ mode is concerned, as the edge conditions in the waveguides 3.1-3.4 of the intermediate section 3 maintain the symmetry and the field configuration.

Figure 2:
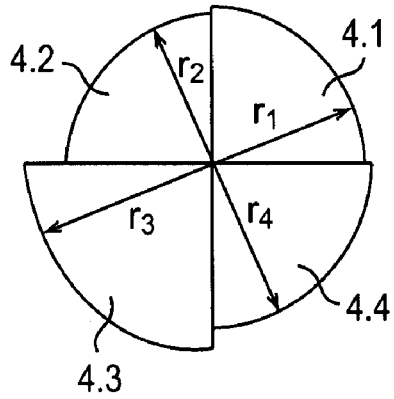
FIG. 2 shows a cross-section through a phase-shift section comprised in the mode converter according to the invention.

Via the intermediate section 3, the four waveguide modes are excited further inside the phase-shift section 4. The phase-shift section contains similarly four waveguides 4.1-4.4. The ridge extensions in the intermediate section continue into the phase-shift section and form four walls which together with the outer boundaries of the phase-shift section form the four waveguides 4.1-4.4. The four waveguides have cross-sections that are in the shape of circle sectors with four different radii $r_1$-$r_4$. A schematic cross-section through the phase-shift section 4 is shown in FIG. 2. The different radii $r_1$-$r_4$ give different propagation constants. During propagation through the phase-shift section, the waves in the different waveguides are therefore given a phase shift relative to each other. Theoretically, a length is required that is longer than $\lambda_0/2$ in order to obtain a phase shift of 180 degrees between two of the waveguides and consequently $\lambda_0/4$ in order to obtain a phase shift of 90 degrees. In practice, however, a considerably longer length is required in order to achieve this phase shift, particularly if we want to obtain different phase shifts between different pairs of waveguides. By means of a suitable choice of the length of the phase-shift section 4 and the radii $r_1$-$r_4$ of the individual waveguides 4.1-4.4, a phase shift of 180 degrees is arranged between the waveguides in each pair of diagonally opposite waveguides, that is between 4.1 and 4.3 and between 4.2 and 4.4. In addition, the radii $r_1$-$r_4$ are selected in such a way that a phase shift of 90 degrees is obtained between two adjacent waveguides. A suitable length of the phase-shift section can be $2\lambda_0$.

The phase-shift section 4 changes into a balance section 5 by means of the four waveguides 4.1-4.4 in the phase-shift section 4 being given the same radius. In this way, the waveguides 5.1-5.4 are given identical cross-sections that are in the shape of circle sectors. The radius in the waveguides is so small that only one mode can propagate in each waveguide. The length of the balance section is preferably $\geqq\lambda_0/4$. The task of the balance section is to balance the field configurations of the different waveguides prior to the change to the subsequent mode-mixer section.

Figure 4D:
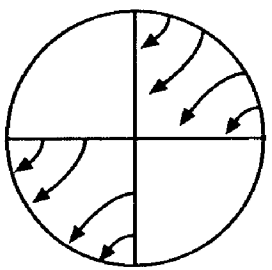
Figure 4E:
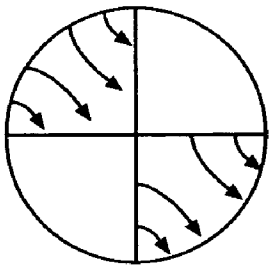
Figure 5A:
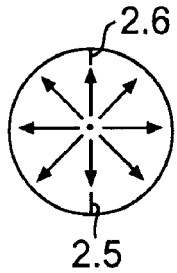
FIG. 5 shows schematically the transverse E-fields in different parts of a mode-converting arrangement according to the invention with change to one $TE_{11}$ mode.
Figure 5B:
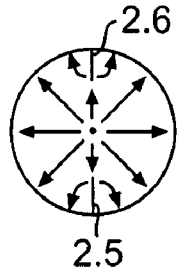
Figure 5C:
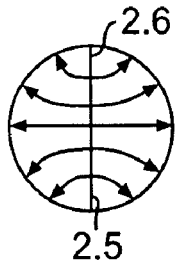
Figure 5D:
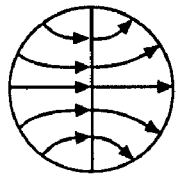

In the mode-mixer section 6, the dividing walls are arranged so as to disappear. The change can be carried out abruptly without affecting significantly the matching of the mode-converting arrangement. Alternatively, the change can be carried out gradually. The mode-mixer section is essentially a circular waveguide section without dividing walls. The mode-mixer section is preferably given a radius such that only three modes can propagate, namely two degenerated basic modes ($TE_{11}$), and one first higher-level mode ($TM_{01}$). The latter is not excited significantly. The mode-mixer section 6 is preferably dimensioned to have a length that exceeds $\lambda_0/4$ and can, for example, have a length amounting to $\lambda_0/2$. The task of the mode-mixer section is to excite the required $TE_{11}$ modes 90 degrees out of phase to obtain a circular polarization. This is carried out in a natural way by means of the phase shifts that are achieved in the phase-shift section 5. The output of the mode-mixer section can, for example, be connected to a horn antenna that is conical shaped and/or has corrugated walls, if required for illumination of a reflecting antenna. FIGS. 4*d* and 4*e* show schematically the appearance of the transverse E-fields at the input of the mode-mixer section, where the time difference between the field configurations is a quarter of a period.

Figure 6:
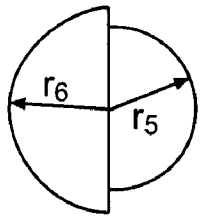
FIG. 6 shows a cross-section through a simpler phase-shift section comprised in a mode-converting arrangement according to the invention.

The example described above concerned conversion from $TM_{01}$ mode to two $TE_{11}$ modes, 90 degrees out of phase. In a somewhat simplified embodiment, the mode-converting arrangement can be designed to convert an incoming $TM_{01}$ mode to one $TE_{11}$ mode. In such a simplified mode-converting arrangement, the input section 2 has only two ridges that increase in size from two diametrically-opposite positions on the circular cylindrical surface of the input section. The intermediate section 3 will then consist of two waveguides with semicircular cross-section. In the phase-shift section 4, that now consists of two waveguides with semicircular cross-section and different radii, a phase shift of 180 degrees is introduced between the modes propagating in the waveguides. FIG. 6 shows a cross-section through the phase-shift section 4 with the two radii being designated by $r_5$ and $r_6$. The balance section 5 and mode-mixer section 6 are introduced analogously with the description above of the generation of two $TE_{11}$ modes, with, however, the balance section here only comprising two waveguides.

FIG. 5 shows schematically the transverse E-fields for the simplified embodiment. FIGS. 5*a* to 5*c* relate to the same cross-section within the input section 2 as described above for the embodiment shown in FIG. 1, that is at the input of the input section, somewhere in the middle of the input section and at the output side of the input section. In the simplified embodiment, there are only two ridges 2.5 and 2.6 that increase in size to become one complete dividing wall. FIG. 5*d* shows the appearance of the field configuration at the input of the mode-mixer section 6.

The invention is not limited to the embodiments described in the above as examples, but can be modified within the framework of the following patent claims.

The invention claimed is:

1. A method for conversion of waveguide modes from a mode of type $TM_{01}$ to mode of type $TE_{11}$ for transmission of power within a microwave range, the method comprising:

dividing an incoming power of mode type $TM_{01}$ between two or more waveguides with cross-sections essentially in a shape of circle sectors, phase-shifting the divided power by the waveguides in a subsequent phase-shift section with waveguides having cross-sections essentially in the shape of circle sectors having different radii, and changing the waveguides into a common essentially circular waveguide that emits an outgoing power of mode type $TE_{11}$.

2. The method according to claim 1, wherein the conversion of the waveguide mode from mode type $TM_{01}$ to mode type $TE_{11}$ is caused, in an intermediate stage comprising four separate waveguides, to assume a field configuration for the basic modes of the respective waveguides that constitutes one quarter of a $TE_{21}$ mode in a corresponding circular waveguide.

3. A mode converting arrangement for conversion of wave guide modes from a mode of type $TM_{01}$ to mode of type $TE_{11}$ for transmission of power within a microwave range, comprising an incoming waveguide for reception of power of the type $TM_{01}$ , an outgoing waveguide for outputting power of the mode type $TE_{11}$ and a waveguidemode-converting section arranged between the incoming and outgoing waveguides, wherein the waveguide-mode-converting section comprises at least one input section for dividing received power into two or more components and a phase-shift section at an output side of the input section with an allocated waveguide for each power component, wherein the waveguides comprise cross-sections that are essentially in a shape of circle sectors with different radii emanating from a common center and such that the cross-sections in the shape of circle sectors together essentially cover 360 degrees.

4. The mode-converting arrangement according to claim 3, wherein the phase-shift section has a length in a transmission direction of at least $\lambda_0/4$ where $\lambda_0$ denotes a free-space wavelength of a center frequency in a band that is transmitted by the arrangement.

5. The mode-converting arrangement according to claim 3, further comprising:

a mode-mixer section operatively connected to the outgoing waveguide, the mode-mixer section comprising a change from a plurality of waveguides with cross-sections in the shape of circle sectors to one waveguide with an essentially circular cross-section.

6. The mode-converting arrangement according to claim 5, wherein the change in the mode-mixer section is abrupt.

7. The mode-converting arrangement according to claim 5, wherein the change in the mode-mixer section is gradual, by the change having an extent in a transmission direction that corresponds to at least $\lambda_0/4$, where $\lambda_0$ denotes a free-space wavelength for a center frequency in a band that is transmitted by the arrangement.

8. The mode-converting arrangement according to claim 5, wherein an output of the mode-mixer section forms the outgoing waveguide of the arrangement.

9. The mode-converting arrangement according to claim 3, further comprising:

a balance section connected to an output side of the phase-shift section and comprising waveguides with cross-sections that are essentially in a shape of circle sectors with the same radii, in order to balance field configurations of the waves that leave the different waveguides of the phase-shift section.

10. The mode-converting arrangement according to claim 3, further comprising:

an intermediate section arranged between the input section and the phase-shift section, which intermediate section comprises a plurality of waveguides with cross-sections in a shape of circle sectors and essentially identical radii.

11. The mode-converting arrangement according to claim 3, wherein the input section is configured to divide the received power into two components.

12. The mode-converting arrangement according to claim 3, wherein the input section is configured to divide the received power into four components.

13. The mode-converting arrangement according to claim 3, wherein the input section comprises thin ridges for dividing the received power, wherein the ridges increase in size in a transmission direction from a periphery of the input section inwards towards a middle of the input section so that they meet at the output side of the input section.

14. The mode-converting arrangement according to claim 13, wherein the ridges increase in size continuously in the transmission direction.

15. The mode-converting arrangement according to claim 13, wherein the ridges increase in size in steps in the transmission direction.

16. An antenna arrangement comprising a mode-converting arrangement according to claim 3.

17. The mode-converting arrangement according to claim 4, wherein the phase-shift section has a length in the transmission direction of $2\lambda_0$.

* * * * *